US008150654B2

(12) United States Patent
Ho et al.

(10) Patent No.: US 8,150,654 B2
(45) Date of Patent: Apr. 3, 2012

(54) CHILLER'S PERFORMANCE TESTER

(76) Inventors: Chung Yueh Ho, Kaohsiung (TW); Cheng-Ta Ho, Kaohsiung (TW)

( * ) Notice: Subject to any disclaimer, the term of this patent is extended or adjusted under 35 U.S.C. 154(b) by 299 days.

(21) Appl. No.: 12/640,000

(22) Filed: Dec. 17, 2009

(65) Prior Publication Data

US 2011/0153274 A1 Jun. 23, 2011

(51) Int. Cl.
*G06F 11/30* (2006.01)
*G21C 17/00* (2006.01)

(52) U.S. Cl. ..... 702/182; 702/127; 702/81

(58) Field of Classification Search ..... 702/81, 702/116, 117, 118, 122, 127, 182, 183; 700/108, 700/121, 174, 178
See application file for complete search history.

(56) References Cited

U.S. PATENT DOCUMENTS 7,827,005 B2 * 11/2010 Kimball ..... 702/182
2008/0114569 A1 * 5/2008 Seigel ..... 702/182

FOREIGN PATENT DOCUMENTS

CN 201611312 U * 10/2010

OTHER PUBLICATIONS

AHRI Standard 550/590 (formerly ARI Standard 550/590), 2003 Standard for Performance Rating of Water-Chilling Packages Using the Vapor Compression Cycle, 2003.*

* cited by examiner

*Primary Examiner* — Drew A Dunn
*Assistant Examiner* — Yaritza H Perez Bermudez
(74) *Attorney, Agent, or Firm* — Leong C. Lei

(57) ABSTRACT

A chiller's performance tester includes two flowrate sensors, four temperature sensors, one current sensor, one voltage sensor, all sensors being externally connectable, and an enclosure in which a thermal energy calculation IC board, an electrical power calculation IC board, and a programmable logic controller are arranged. The enclosure has a front side to which a man-machine interface panel that displays measurement readings and provides function-related operations is mounted. The enclosure has a back side to which a socket-carrying panel that is connectable to cables of the sensors is mounted. Readings of flowrate, temperature, current, and voltage are transmitted to the programmable logic controller in which software is executed to compile and integrate these signals to be further transmitted to a computer for subsequent analysis and monitoring. Test of a water chiller is made simple and cost, man power, and working hours are saved.

1 Claim, 4 Drawing Sheets

CHILLER'S PERFORMANCE TESTER

TECHNICAL FIELD OF THE INVENTION

The present invention generally relates to an instrument for testing a water chiller's performance, and more particularly to a portable integrated chiller's performance tester, specifically designed for testing evaporator capacity, condenser capacity and compressor power input of a water chiller.

DESCRIPTION OF THE PRIOR ART

A water chiller is a major equipment for a central air-conditioning system installed in, for example, an office building, a department store, an industrial plant, or a hospital. Since the water chiller consumes about 50% of the total energy consumption of the central air-conditioning system, before a water chiller is shipped, in-factory tests of the water chiller's performance, including evaporator capacity, condenser capacity and compressor power input, have to be conducted in the manufacturing factory to ensure the energy consumption of the water chiller meets the requirement of regulations. On-site test of the water chiller are conducted every two or three years on the site where the water chiller is installed to check for any degrading of the capacity that might lead to excessive waste of electrical power.

As shown in FIG. 1, a typical water chiller 10 is composed of a number of components, including an evaporator 11, a condenser 12 and a compressor 13, and is connected to chilled water pipes 14 and cooling water pipes 15. However, it is noted that the prior art does not have a potable integrated instrument dedicated for testing the performance of a water chiller. According to the APPENDIX C of the Standard 550/590, 2003 of Air-conditioning & Refrigeration Institute (ARI), the test method needs separate test instruments, such as general-purpose flow meter 21, temperature sensors T11-T14, power meter 22 and data logger 23, that must be purchased from different suppliers in order to carry out the test of the capacities of the evaporator, condenser, and compressor of a water chiller. Flowrate sensors F11, F12, a current sensor C1, and a voltage sensor C2 are respectively installed at proper locations on the water pipes 14, 15 and the electrical power cable of the compressor 13. Data detected by the flowrate meter 21, the temperature sensors T12-T14, and the power meter 22 are complied and transmitted by the data logger 23 to a notebook computer 1, in which software, such as EXCEL, is used to carry out compilation and analysis of the data. However, since general-purpose instruments are often for use in various applications and for multiple functions, make them bulky in volume, expensive in cost, and inconvenient for operation. Thus, for testing three kinds of capacities of a water chiller, it needs to prepare a number of separate instruments, which are often expensive, including at least two flow meters (including flowrate sensors), four temperature sensors, one power meter (including current sensor and voltage sensor), and one data logger. This makes the operation very inconvenient. Further, each time for reviewing all the measured data, the format must be re-arranged, leading to waste of man power and working hours. Thus, it is desired to provide a portable integrated instrument and associated software in the industry, in order to overcome the above mentioned drawbacks.

SUMMARY OF THE INVENTION

In view of this situation, the problem intended to be resolved by the present invention is to provide a chiller's performance tester that combines all the functions that are independent in the known techniques, in order to reduce the instrument cost and to make the operation simple and easy, and to save working hours.

To achieve the above object, the technical solution of the present invention provides a portable integrated chiller's performance tester, comprising two flowrate sensors, four temperature sensors, one current sensor, one voltage sensor, all sensors being externally connectable, and an enclosure in which a thermal energy calculation IC board, an electrical power calculation IC board, and a programmable logic controller are arranged. The enclosure has a front side to which a man-machine interface panel that displays measurement readings and provides function-related operations is mounted. The enclosure has a back side to which a socket-carrying panel that is connectable to the cables of all sensors is mounted. Signals indicating the readings of flowrate, temperature, current, and voltage are transmitted to the programmable logic controller in which software is executed to compile and integrate these signals to be further transmitted to a computer for subsequent analysis and monitoring.

As such, the present invention specifically provides a portable integrated instrument that is dedicated for testing three kinds of capacities of a water chiller and that integrates the functions of flow meter, electrical power meter, and data logger separately used in the known techniques, and that also provides dedicated software, whereby the volume and the weight of the instrument are substantially reduced, making carrying of the instrument easy and also offering the advantages of low cost, easy operation, and saving of working hours.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
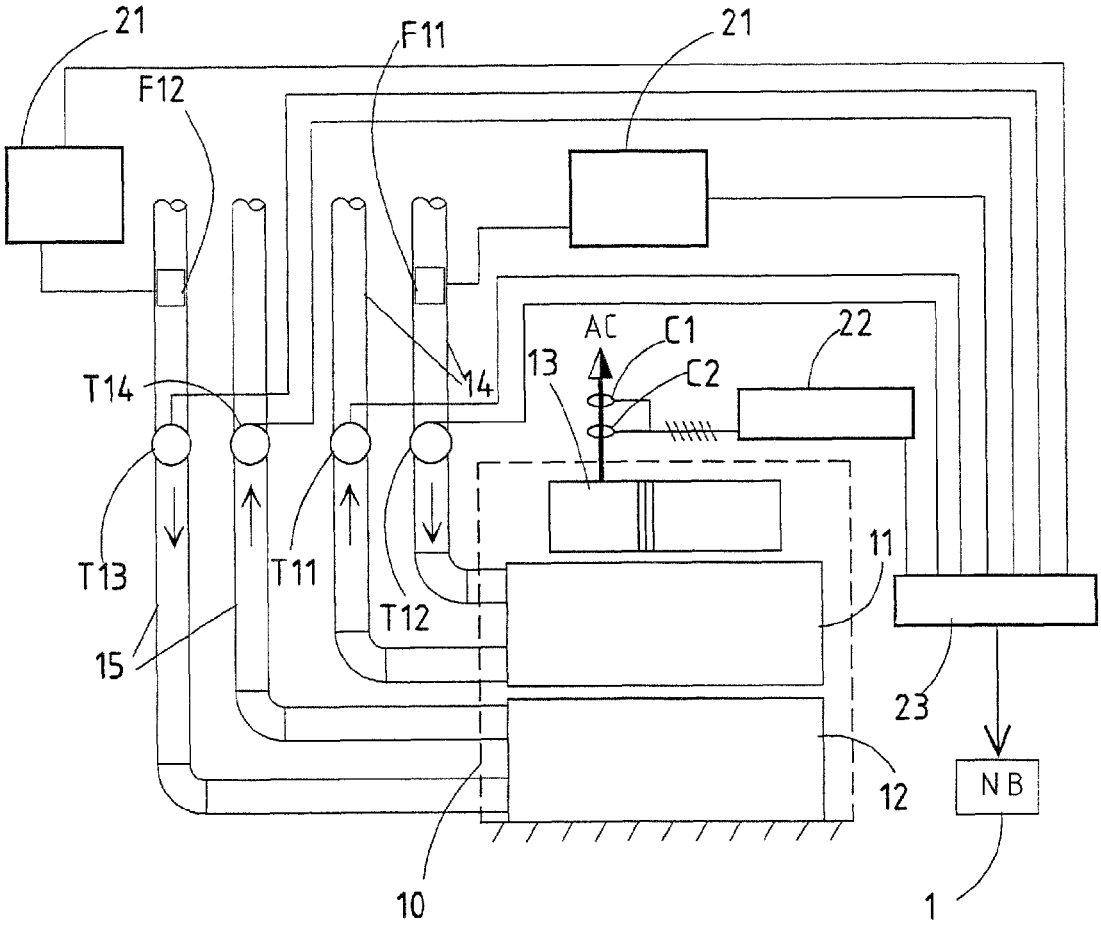
PRIOR ART FIG.1
FIG. 1 is a schematic view showing a test operation of a typical water chiller.
Figure 2:
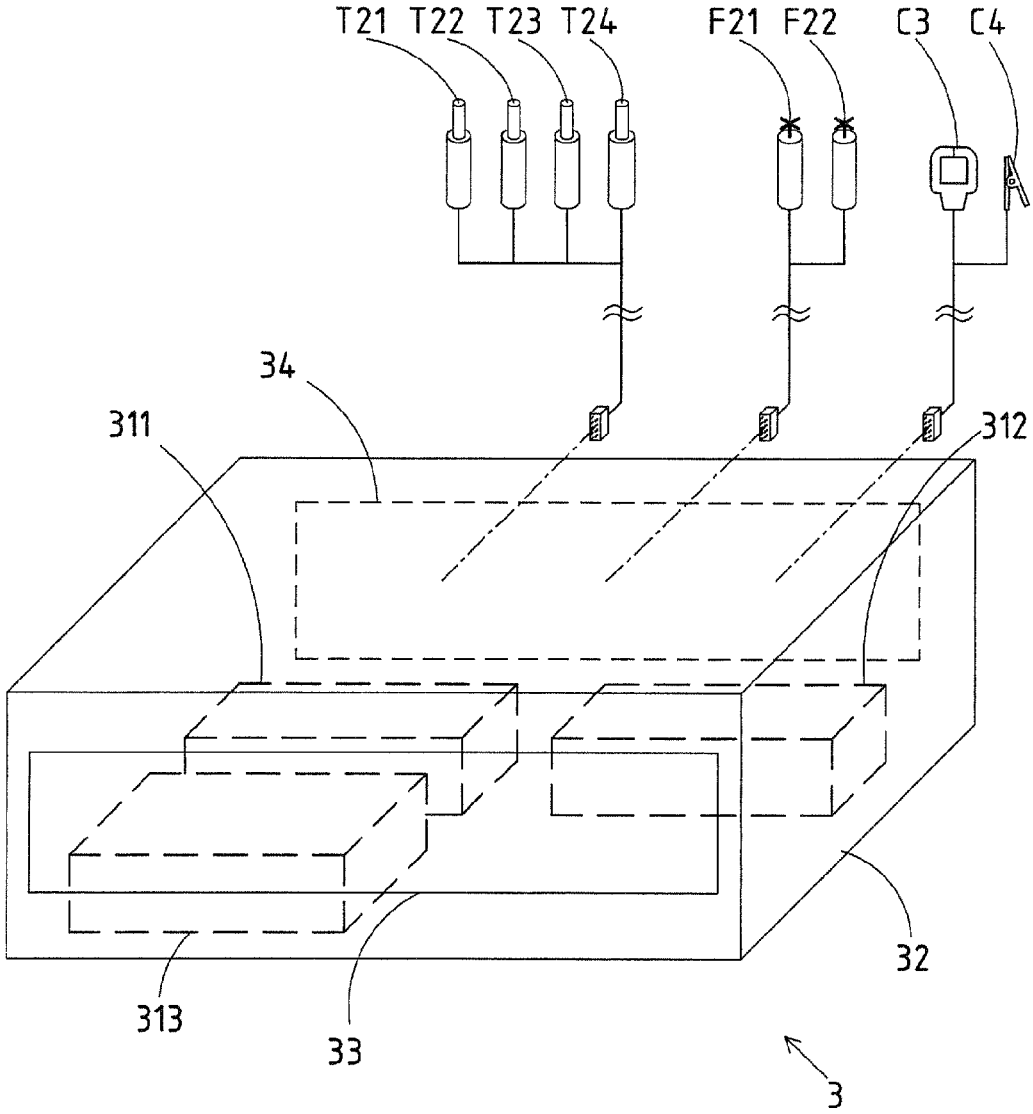
FIG. 2 is a schematic view illustrating an overall structure of the present invention.
Figure 3:
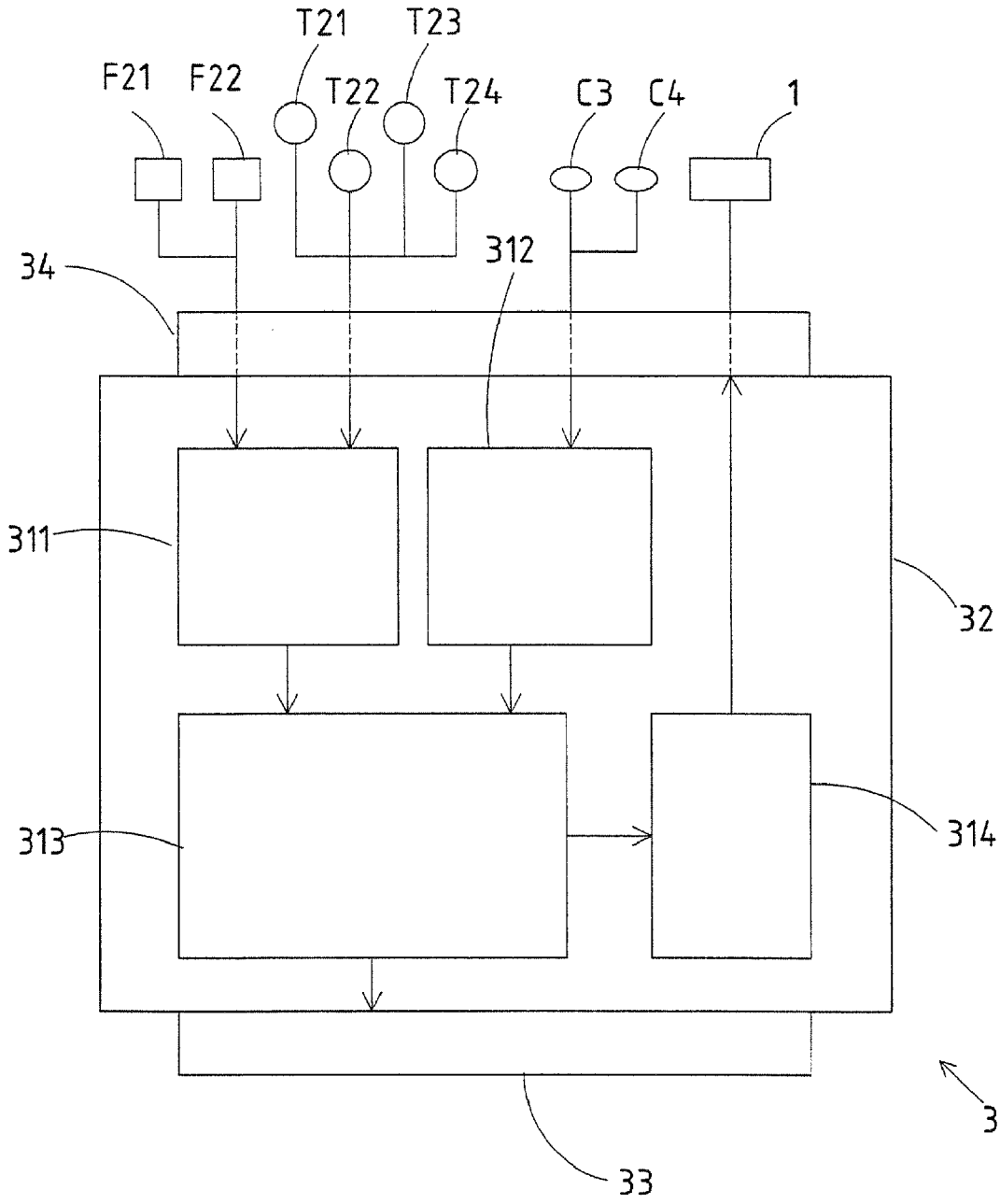
FIG. 3 is a block diagram illustrating flow of transmission of measurement signals in accordance with the present invention.
Figure 4:
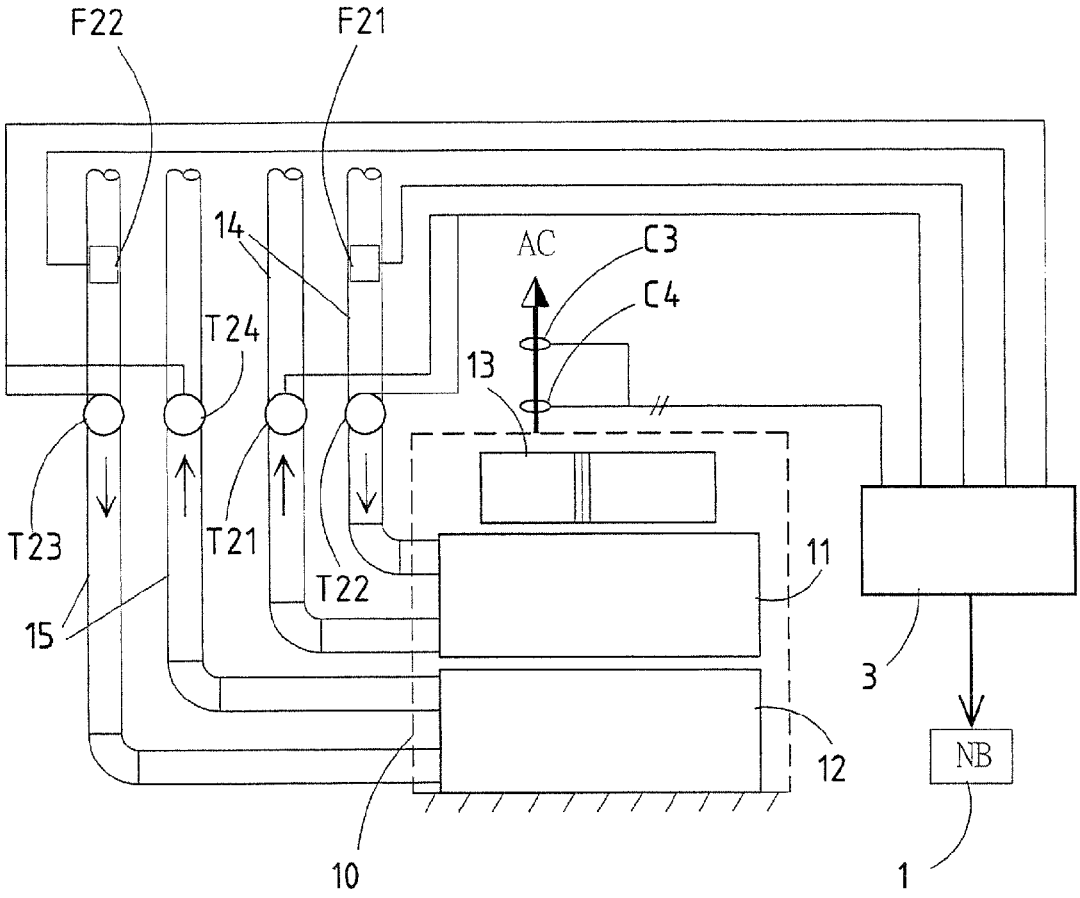
FIG. 4 is a schematic view illustrating an application of the present invention.

Referring to FIGS. 2 and 3, the present invention provides an integrated chiller's performance tester 3, which comprises two flowrate sensors F21, F22, four temperature sensors T21-T24, one current sensor C3, one voltage sensor C4, all being externally connectable, and an enclosure 32 in which a thermal energy calculation IC board 311, an electrical power calculation IC board 312, and a programmable logic controller 313 are arranged. The enclosure 32 has a front side to which a man-machine interface panel 33 that displays measurement readings and provides function-related operations is mounted. The enclosure 32 has a back side to which a socket-carrying panel 34 that is connectable to cables of the sensors is mounted for receiving signals indicating the readings of detections in respect of flowrate, temperature, current, and voltage. The programmable logic controller 313 functions to receive signals supplied from the thermal energy calculation IC board 311 and the electrical power calculation IC board 312, and compile these signals to be transmitted to a notebook computer 1 for subsequent analysis and monitoring. The present invention integrates various operations including flowrate detection, temperature detection, electrical power detection, and data collection, which are necessary for testing three kinds of capacities of a chiller, in a single device, wherein the programmable logic controller 313 is operated to primarily transform logic relationships among the desired data into a program language devoted to the controller, based on which the programmable logic controller 313 processes the data. As shown in FIG. 4, in an application of the chiller's performance tester 3 of the present invention having the above structure, a flowrate sensor F21 is installed on one of chilled water pipes 14 of an evaporator 11 and two temperature sensors T22, T21 are respectively installed on inlet and outlet chilled water pipes 14. A flowrate sensor F22 and two other temperature sensors T23, T24 are respectively installed on one of cooling water pipes 15 of a condenser 12 and inlet and outlet cooling water pipes 15. A current sensor C3 and a voltage sensor C4 are installed on the electrical power cable of a compressor 13. When the chiller is put into operation, the thermal energy calculation IC board 311 and the electrical power calculation IC board 312 of the chiller's performance tester 3 of the present invention calculate thermal energy (=flowrate×temperature difference between inlet and outlet pipes) and electrical power input according to the data of flowrate, temperature, current, and voltage detected by the flowrate sensors, the temperature sensors, the current sensor, and the voltage sensor, and the result of calculation is transmitted to the programmable logic controller 313 to be complied and integrated by the software executed therein for subsequent transmission to the notebook computer 1 for analysis and monitoring. Parameters related to the detection operations can be input and set through the man-machine interface panel 33.

From the above description of the embodiment of the present invention, it is noted that the chiller's performance tester of the present invention is structured to integrate the functions of individual flowrate meter, power meter and data logger together in a single device, and provides dedicated data processing software, whereby the cost of the tester is substantially reduced and the operation is made simplified for saving man power and working hours.

Further, in the performance of testing three kinds of capacities of a chiller, the operation related data are immediately shown on a screen of the notebook computer and are saved in the computer. Thus, correctness of the data can be immediately checked on the screen. In case that an item of the data is abnormal, which indicates the preciseness of a related sensor is incorrect or the installation of the sensor is incorrect, immediate correction can be done to remove the problem. When the test is done, all the measured data of previous test operations can be reviewed by simply showing the operation data table of each time point on the screen and there is no need to depend upon the operation of EXCEL program of the computer to re-arrange the format of table and screen displaying as required in the known techniques. Thus, man power and working hours can be reduced and operation convenience can be enhanced.

To summarize, the present invention uses a thermal energy calculation IC board, an electrical power calculation IC board, and a programmable logic controller that are manufactured specifically for testing three kinds of capacities of a water chiller to replace the flow meter, electrical power meter, and the data logger used in the known techniques. As compared to the known techniques, the present invention possesses novelty and progress, and can achieve the desired objects thereof and actually overcomes the long-existing problem of no portable integrated chiller's performance tester. Apparently, the present invention meets the needs of the industry and an application for patent is thus filed according to related regulations and laws. Although the present invention was described with reference to a preferred embodiment thereof, yet it is understood that the present invention is not limited to such an embodiment and those having ordinary skills may make alteration and modification of the embodiment without departing from the sprit and scope of the present invention. Thus, the present invention is only defined by the claims attached herein.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A portable integrated chiller's performance tester, comprising two flowrate sensors, four temperature sensors, one current sensor, one voltage sensor, all sensors being externally connectable, and an enclosure in which a thermal energy calculation IC board, an electrical power calculation IC board, and a programmable logic controller are arranged, the enclosure having a front side to which a man-machine interface panel that displays measurement readings and provides function-related operations is mounted, the enclosure having a back side to which a socket-carrying panel that is connectable to cables of the sensors is mounted, wherein signals indicating the readings of the sensors are transmitted to the thermal energy calculation IC board and the electrical power calculation IC board and are further transmitted to the programmable logic controller in which software is executed to compile and integrate these signals to be further transmitted to a notebook computer.

* * * * *